US008106792B2

(12) United States Patent
Chen et al.

(10) Patent No.: US 8,106,792 B2
(45) Date of Patent: Jan. 31, 2012

(54) PROGRAM AND METHOD FOR ADAPTIVE MOBILE AD-HOC WIRELESS COMMUNICATION

(75) Inventors: Wai Chen, Parsippany, NJ (US); Jasmine Chennikara-Varghese, Somerset, NJ (US); Taek-Jin Kwon, Morganville, NJ (US); Ryokichi Onishi, Kanagawa (JP); Rama Vuyyuru, Somerset, NJ (US)

(73) Assignees: Telcordia Technologies, Inc., Piscataway, NJ (US); Toyota Infotechnology Center, U.S.A., Inc., Palo Alto, CA (US)

( * ) Notice: Subject to any disclaimer, the term of this patent is extended or adjusted under 35 U.S.C. 154(b) by 397 days.

(21) Appl. No.: 12/500,685

(22) Filed: Jul. 10, 2009

(65) Prior Publication Data

US 2011/0006913 A1 Jan. 13, 2011

(51) Int. Cl.
*G08G 1/09* (2006.01)

(52) U.S. Cl. ..... 340/905; 340/901; 340/902

(58) Field of Classification Search ..... 340/905, 340/901, 902

See application file for complete search history.

(56) References Cited

U.S. PATENT DOCUMENTS 7,720,026 B2 * 5/2010 Chen et al. ..... 370/328

* cited by examiner

*Primary Examiner* — Travis Hunnings
(74) *Attorney, Agent, or Firm* — Philip J. Feig

(57) ABSTRACT

A method of controlling a wireless communication device that is installed in a moving vehicle. The method comprises receiving roadway topology information and vehicle traffic pattern information, receiving vehicle and wireless communication device performance information from a plurality of other moving vehicles, determining current position information for the moving vehicle; determining a first set of metrics for a performance of the wireless communication device installed in the moving vehicle, estimating at least one second metric related to the performance of the wireless communication device or an ad-hoc network which includes each wireless communication device and changing an operation or routing parameter for the wireless communication device based upon the estimation. The second metric is based upon at least a sub-set of the first set of metrics, the received information and the determined current position information for the moving vehicle.

16 Claims, 8 Drawing Sheets

PROGRAM AND METHOD FOR ADAPTIVE MOBILE AD-HOC WIRELESS COMMUNICATION

FIELD OF THE INVENTION

The present invention relates to a communications network in a mobile environment. More specifically, the invention relates to a wireless communications system, a wireless communications device, a program and a method for adaptively controlling the system and device based upon local environmental and network conditions.

BACKGROUND

Mobile ad-hoc networks have become increasingly important in areas where deployment of communication infrastructure is difficult. A mobile ad-hoc network (MANET) is formed by multiple moving nodes equipped with wireless transceivers. The mobile nodes communicate with each other through multi-hop wireless links. Each node equipped with a wireless transmission can transmit and receive information.

One type of MANET is a vehicular ad-hoc network (VANET) that refers to a mobile ad-hoc network designed to provide communications among nearby vehicles and between vehicles and nearby fixed equipment. In a typical roadway, there are vehicles that are equipped with a wireless communication device and others that are not. Road conditions vary in different environments such as a metropolitan areas verses a rural environments as well as for different types of roads such as highways, interstates, tunnels, local roads and bridges.

This variation in local environmental conditions affects the performance of a wireless communications device and ultimately the ad-hoc network that includes multiple communication devices. In a VANET the variance in local environmental conditions and the change in performance of each wireless communication device due to the variance of the local environmental conditions are accentuated since each vehicle is moving at high speeds. Key performance requirements include low latency (on the order of 100 milli-seconds) and sustained throughput (or equivalently, the percentage of neighboring vehicles that successfully receive warning messages) in order to support various applications such as collision avoidance. For example, information that is necessary for setting up safety communications must be exchanged in real-time, and vehicles in the groups must configure themselves in real-time so that safety communication can take place. The high mobility of uncoordinated vehicles implies frequent change of neighbors or vehicle groups, and poses difficulties of using support-servers (for mobility, address, name, media session) within vehicle groups. These key differences make existing mobile ad-hoc networking technologies (such as tactical ad-hoc networking) not directly applicable to vehicle groups.

Therefore, a wireless communication device must be able to adjust its performance or operating parameters based upon the change in local environmental conditions.

SUMMARY OF THE INVENTION

Accordingly, disclosed is a method of controlling a wireless communication device that is installed in a moving vehicle. The method comprises receiving roadway topology information and vehicle traffic pattern information, receiving vehicle information from a plurality of other moving vehicles and wireless performance parameters corresponding to each of the plurality of other moving vehicles related to the performance of a wireless communication device installed in each of the plurality of other moving vehicles, determining current position information for the moving vehicle, determining a first set of metrics for a performance of the wireless communication device installed in the moving vehicle, estimating at least one second metric related to the performance of the wireless communication device or an ad-hoc network which includes each wireless communication device, and changing an operation or routing parameter for the wireless communication device based upon the estimation. The at least one second metric is based upon at least a sub-set of the first set of metrics, the received roadway topology information, vehicle traffic pattern information, vehicle information and wireless performance parameters from the plurality of other moving vehicles and the determined current position information for the moving vehicle.

The method includes storing the received roadway topology information, vehicle traffic pattern information, vehicle information and wireless performance parameters from each of the plurality of other moving vehicles, the first set of metrics, the current position information, the estimated at least one second metric and the changed operation or routing parameters as stored data in memory. The stored data is maintained for a period of time as network operating history.

The method includes transmitting periodically the network operating history to at least a subset of the plurality of other moving vehicles. The transmission period is adjustable based upon the received roadway topology information, vehicle traffic pattern information, vehicle information and wireless performance parameters from each of the plurality of other moving vehicles, the first set of metrics, the current position information, and the estimated at least one second metric.

The method further includes providing the stored network operating history to an application layer, an IP network layer, a MAC layer and physical layer for the determining of the first set of metrics and the estimating of the at least one second metric. The information is shared between the layers.

The method further includes selecting a method for estimating the at least one second metric from a plurality of methods. The method is selected based upon at least one prior period of the estimated at least one second metric and the determined first set of metrics and location information for a current period.

The estimation of the at least one second metric is periodically performed. The period is adjustable based upon at least one prior period of the estimated at least one second metric and the determined first set of metrics and location information for a current period.

The roadway topology information and vehicle traffic pattern information is received from a roadside unit. Alternatively, the roadway topology information and vehicle traffic pattern information is downloaded from mapping and traffic applications. The roadway topology information and vehicle traffic pattern information includes speed limit, number of lanes, direction of traffic, type of roadway, intersection information, traffic light locations and regions.

The vehicle information includes vehicle make, model, size, speed, direction and location.

The at least one second metric is a predicted next-hop neighbor, a vehicle density and/or a one-hop MAC capacity.

Also disclosed is a program containing instructions for causing a computer to execute the above-identified methods. The program is stored in a computer readable medium.

BRIEF DESCRIPTION OF THE DRAWINGS

These and other features, benefits, and advantages of the present invention will become apparent by reference to the following figures, with like reference numbers referring to like structures across the views, wherein.

DETAILED DESCRIPTION OF THE INVENTION

Definitions

An "equipped vehicle" is a moving vehicle with a wireless communication device.

A "Node" is a router which implements the routing protocol or method as specified in the following description. For example, an equipped vehicle is a node. For the purposes of this application, a node and equipped vehicle are interchangeably used.

A "neighbor node" means that there is a direct wireless communication link between two nodes. A node X is a neighbor node of node Y if node Y can hear node X and node X can hear node Y.

A "hop" is a number of nodes in which a message is relayed. The hop count for a neighboring node is 1.

Figure 1:
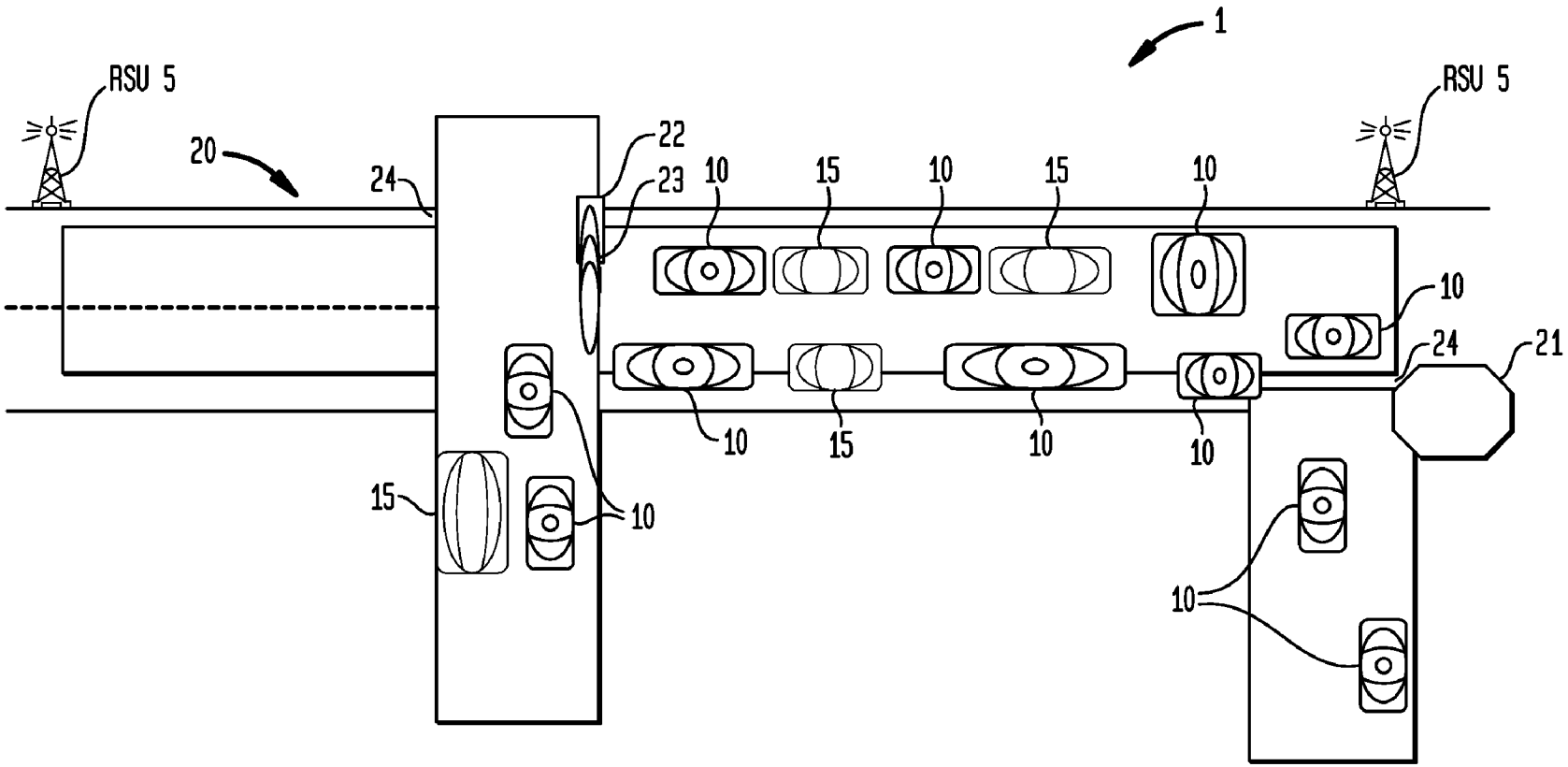
FIG. 1 illustrates an exemplary local roadway environment and ad-hoc network in accordance with the invention.

FIG. 1 illustrates an example of a local environment 1 with an ad-hoc network. As depicted, the roadway 20 includes two intersections 24. At one of the intersections 24, a stop sign 21 is located on a corner of the roadway 20. The other intersection 24 includes a traffic signal 23 and a camera 22. Along the side of the roadway 20 are two roadway side units ("RSUs") 5. The RSU 5 serves as a routing node and an interface to a backbone network (not shown). The RSU also includes information regarding the roadway 20 and local environment 1. The roadway 20 has two types of moving vehicles: equipped vehicles 10 and non-equipped vehicles 15. Non-equipped vehicles 15 cannot communicate with each other. The number of non-equipped vehicles 15 can be directly estimated based upon information from the camera 22 or RSU 5 or deduced by information regarding the type of roadway, time of day and location within the roadway 20 and a probability that a vehicle is equipped.

FIG. 1 depicts a roadway 20 with two lanes of traffic. However, a roadway 20 is not limited to two lanes; the roadway 20 can be any number of lanes. Additionally, FIG. 1 depicts traffic moving in one direction, however, traffic can move in any direction, i.e., two-way traffic.

Figure 2:
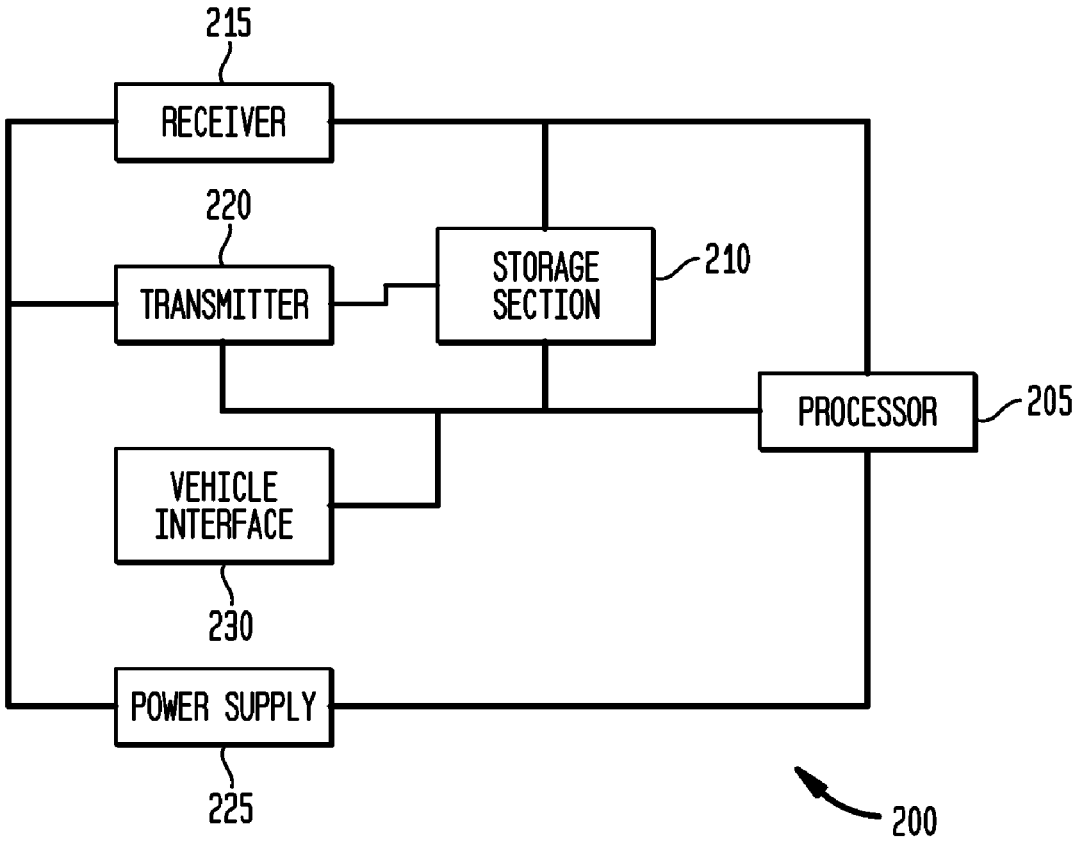
FIG. 2 illustrates an exemplary wireless communications device installed in a vehicle in accordance with the invention.

FIG. 2 illustrates an exemplary wireless communication device 200 in accordance with the invention.

An equipped vehicle 10 will include the communications device 200 which can be attached to, embedded in or used in combination with the moving vehicle.

The communications device 200 includes a computing device or processor 205, a storage section 210, a receiver 215, a transmitter 220, a power source 225 and a vehicle interface 230. The receiver 215 and transmitter 220 are for providing wireless communication between nodes (include the RSUs) in a radio coverage range. While the receiver 215 and transmitter 220 have been illustrated in as two separate elements, the receiver 215 and transmitter 220 can be incorporated together as a transceiver.

The processor 205 can be any type of control device such as, but not limited to, a microcontroller, a microprocessor, ASIC, FPGA or other logic device. The processor 205 provides operational control by executing instructions, which have been programmed. A storage section 210 is electrically coupled to the processor 205 and is in operational communication with the processor 205. The storage section 210 may be memory modules, removable media or a combination of multiple storage devices, etc., and is configured to store the processor-executable instructions necessary for the performance of the methods and protocols described herein. The storage section 210 can include a priori roadway information, vehicle information (equipped vehicle 10 and non-equipped vehicle information 15) and network topology information. For example, the roadway information can be programmed with map information such as where intersections 24 and street lights 23 are located, the speed limit in a given area, and the locally advertised information for the area as well as specific information on the type of roadway structure (e.g. multi-level highway, city intersection, etc.). The information regarding the roadway 20 could be obtained from road maps and GPS coordination. The programming can occur during installation or periodically downloaded from a home personal computer. Additionally, vehicle specifications such as model, make and size can be known a priori and programmed during installation. In an embodiment, the vehicle specifications, such as vehicle size, are used to estimate vehicle density. The vehicle specifications for vehicles can be periodically transmitted.

The processor 205 includes at least one timing section. Alternatively, the timing section can be a separate component. The timing section provides the time interval tracking necessary for each of the timers referred to in the described embodiments, such as, but not limited to a determination/estimation timer and a probe packet timer.

The communications device 200 can also include a location determining section (not shown) such as a GPS device. Alternatively, the location determining section can be external such as one located in the equipped vehicle 10 and the location information transmitted to the communications device 200 through a vehicle interface 230. Additionally, other location information such as a compass direction and speed can also be transmitted to the communications device 200 from the equipped vehicle 10 via the vehicle interface 230. In an embodiment, the direction and speed can be estimated based upon a previous position estimation and time between estimations.

A power source 225 is electrically connected to all the components of the communications device 200 for providing operational power to the components as necessary. The communications device 200 further includes an internal clock that maintains a clock for the device and is used as the timestamp for all messages.

The processor-executable instructions for performing the described embodiments may be embedded in the storage section 210 in a form such as an EPROM, Flash memory or other such non-volatile storage. Additionally, the processor-executable instructions may be stored on a computer readable media such as an optical or magnetic medium. Preferably, a user, as necessary, can periodically update the processor-executable instructions in order to provide additional enhancements to the network as they become available.

Each communications device 200 is assigned a unique identifier to facilitate the transmission and reception of messages over the ad-hoc network. The unique identifier can be any number that is uniquely assigned to the communications device 200 so that no device within a specific area has the same unique identifier. This identifier must be assigned quickly to support immediate communication, if necessary. The unique identifier can be any unique number or address that facilitates communication, such as a MAC address, VIN number or IP address, the identifier is used as the node's identifier. Any equipped vehicle 10 with the communications device 200 can be a node of an ad-hoc network.

Figure 3:
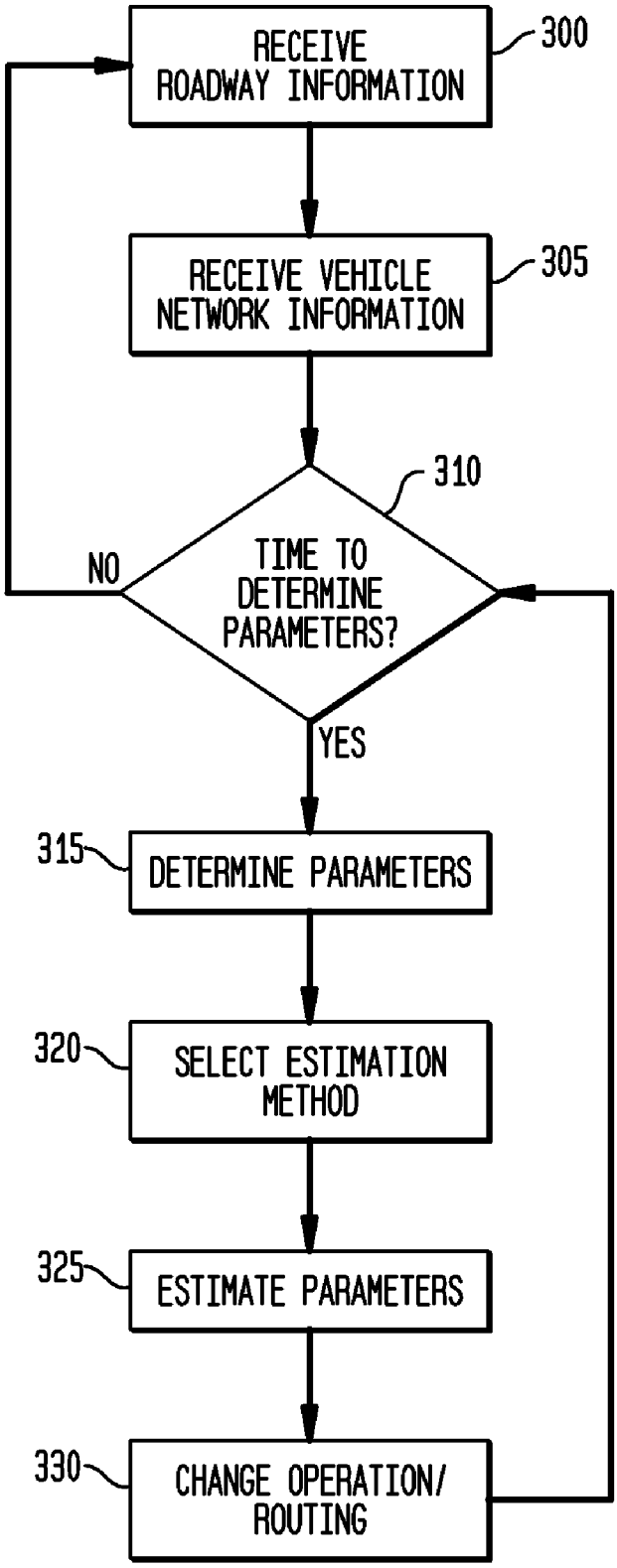
FIG. 3 illustrates a flow chart for a method of controlling the exemplary wireless communications device according to the invention.

FIG. 3 illustrates a method of controlling a wireless communications device 200 according to the invention. In accordance with the invention, the wireless communications device 200 receives and determines parameters related to the environment and network. The information is related to three categories of information: local wireless communication parameters, local roadway environmental conditions and other vehicle (equipped vehicles 10 and non-equipped 15 vehicles) information.

At step 300, the equipped vehicle 10 receives roadway information via the wireless communications device 200. This information is stored in the storage section 210. In an embodiment, an RSU 5 continuously broadcasts the roadway information. Additionally, the roadway information can be received from other equipped vehicles 10 via a probe packet. Roadway information can include non-vehicle related information such as roadway structure, RSU 5 availability along the roadway 20, and the existence of multi-level roadways.

The information further includes, but is not limited to, locations of intersections 24, speed limits, locations of stop signs 21, elevations, vehicle traffic patterns, type of roadway, highway exit information, RSU 5 availability and type of area. The type of roadway can be, but not limited to, highway, interstate, expressway, local road, dirt road, bridge, tunnel and one or two-way road. A type of area includes, but not limited to, urban, metropolitan or rural.

This roadway information is used to predict or estimate a next-hop equipped vehicle 10 for a node, adjust transmitter 220 or receiver 215 radio range, period of determining of the local parameters or estimating local or network information and estimate vehicle density.

For example, if the roadway structure is a highway the equipped vehicles 10 can predict higher speeds which will impact wireless propagation as well as result in more unstable neighbors (due to differing speeds). Using this information, a node can choose neighbors, i.e., next-hop equipped vehicles 10 with similar speed characteristics such that routing paths remains stable. The next-hop neighbor prediction also uses information related to speed and location of the predicting equipped vehicle and other equipped vehicles 10 speed and location. In another example, if the roadway structure is a rural highway, the radio ranges may be set to a maximum value to reach as many equipped vehicles 10 as possible in a sparser vehicle environment. In city or metropolitan environments, a shorter radio range, i.e., lower receiver 215 and transmitter 220 power is used to reduce interference.

The identification of the RSU 5 access points, e.g., location of an RSU, is used by equipped vehicles 10 to select a transmission channel, e.g. make a decision on whether to use vehicle-to-vehicle or vehicle-to-RSU channel for a specific application. The channel selection is also based on throughput, priority, and other communications requirements.

Furthermore, if the roadway 20 is a city intersection, the equipped vehicle 10 can choose neighbors in different directions to get better roadway traffic information. Additionally, the roadway infatuation is an input for location-based services such as available restaurants, gas stations, and other user-driven preferences.

At step 305, the equipped vehicle 10 receives vehicle and network information from other equipped vehicles 10 in the one-hop area, i.e., neighboring nodes. Each equipped vehicle 10 periodically transmits probe packets. Any equipped vehicle 10 within radio communication range of the broadcasting node will receive the probe packet and senses a link. Each period, the equipped vehicle 10 also checks the status of the connectivity for each link by checking for a received probe packet.

The probe packet includes a broadcasting node's unique identifier and the broadcasting node's location, speed and direction of travel. The time of broadcasting of probe packet can also be included in the message. Furthermore, the probe packet includes the make and model of the equipped 10 vehicle. The make and model information is used to determine the size of the equipped vehicle 10, which can be used to estimate the vehicle density. Additionally, the probe packet will include network information such as number of transmitted packets, received packet, transmission and reception channel, send rate, number of duplicate packets received, MAC protocol information, power and radio range. The information in the probe packet is stored in the storage section 210.

The vehicle and network information from the other equipped vehicles 10 is used to estimate network congestion, network topology and load. Furthermore, the information is used to detect or deduce non-equipped vehicles 15. Non-equipped vehicles 15 cannot be directly detected using a radio link or wireless communication device 200.

The estimated network density (density of equipped vehicles) is used to set a maximum hop count for a packet relay or the transmission power. Furthermore, the estimated network density can be used to prioritize transmission of packets. For example, in a high density area, only high priority packets are transmitted. In a low-density area, the radio transmission range, e.g., transmitter 220 power can be increased.

At step 310, the processor 205 of the equipped vehicle 10 determines whether it is time to determine the local parameters. An equipped vehicle 10 periodically determines the local parameters. The period is adjustable and is based upon a prior period's deter mined parameters and estimations. The processor 205 tracks the determination time using a timer. If the timer elapses, the processor 205 starts the local parameter determination step 315. On the other hand, if there is still time remaining, the processor 205 waits and monitors the receiver 215 for information from other equipped vehicles 10 or RSU 5.

The local parameters include application parameters, MAC layer parameters, network parameters, radio parameters and position information.

The application parameters related to performance requirements for an application such as loss and delay requirements and other application information such as the type of application (unicast, multicast, interactive, etc.). This information is used to support functions of lower layers such as the network and MAC layers. The information is used to select a routing path, next-hop node, to adjust MAC parameters to meet throughput and delay requirements or to select V-R or V-V path to meet throughput and connection duration requirements.

An application can be, but is not limited to, safety, mass information download, traffic flow improvement broadcasts, automatic software updates, diagnostics and services/internet access. The wireless communications device 200 adjusts the network, MAC and radio operating parameters based upon the specific application.

For example, for safety applications, a requirement is that a packet is sent to a plurality of equipped vehicles 10 in a short burst without collision. At the MAC and network layer, the power is adjusted to maximize the range, a channel is selected to reduce packet transmission collision and interference and next-hop equipped vehicles are selected to maximize distribution, i.e., nodes with many neighbors.

Additionally, for the other applications, e.g., mass infatuation download, roadway traffic flow improvement broadcasts, and automatic software updates applications, a requirement is to send the packets to as many nodes as possible for a longer period of time. Therefore, next-hop equipped vehicles 10 are selected to maintain stability.

The MAC parameters include transmission and reception channel, sent and received packets, duplicate packets, data rates, load, QoS, and access time. Radio parameters include radio range and power.

Additionally, the equipped vehicle 10 determines its speed, location, and direction of travel. The determination can be based on GPS information. The local parameters are stored in the storage section 210.

At step 320, an estimation method is selected based upon parameters received in steps 300-305 and a prior period's estimation method and estimation. The selection is dynamic; the selection is based on both the current locally determined parameters, parameters received in steps 300 and 305 and prior period's estimations. The selection will be described in detail later. At step 325, at least one performance parameter is estimated. The performance parameter is based upon the roadway information, information received from the other equipped vehicles 10 and the determined local parameters.

Each parameter can have multiple dependencies. The dependencies can be estimated using more than one method. The method depends on the application as well as other current environment conditions. Each parameter is related to the overall local and network environment, i.e., inter-related. For example, there can be a correlation between the type of vehicle and time of day and the type of vehicle driver.

Each period's estimation is dependent on the prior period's estimation. Initially, a first method or default method is selected. The default method assumes some dependency method. The method is selected or updated based on current local information (step 315) and received information (step 300 and 305) and the prior estimation. Then the estimation of a specific environment aspect is made based on the known dependencies. For example, the throughput and delay experienced by the application is heavily dependent on the network route selections which are in turn based on the MAC path throughput. The estimated parameter can be the vehicle density, next-hop equipped vehicle, one-hop MAC capacity and end-to-end MAC capacity.

At step 330, the processor 205 updates the routing path or operating parameters based upon the estimation. The operating parameter(s) can include, but not limited to, transmission range, power, backoff time, period between determinations/estimations, probe packet delivery period, priority, and channel. The routing path can be changed to default to transmission via the RSU 5. Additionally, the routing next-hop information is updated.

Figure 4:
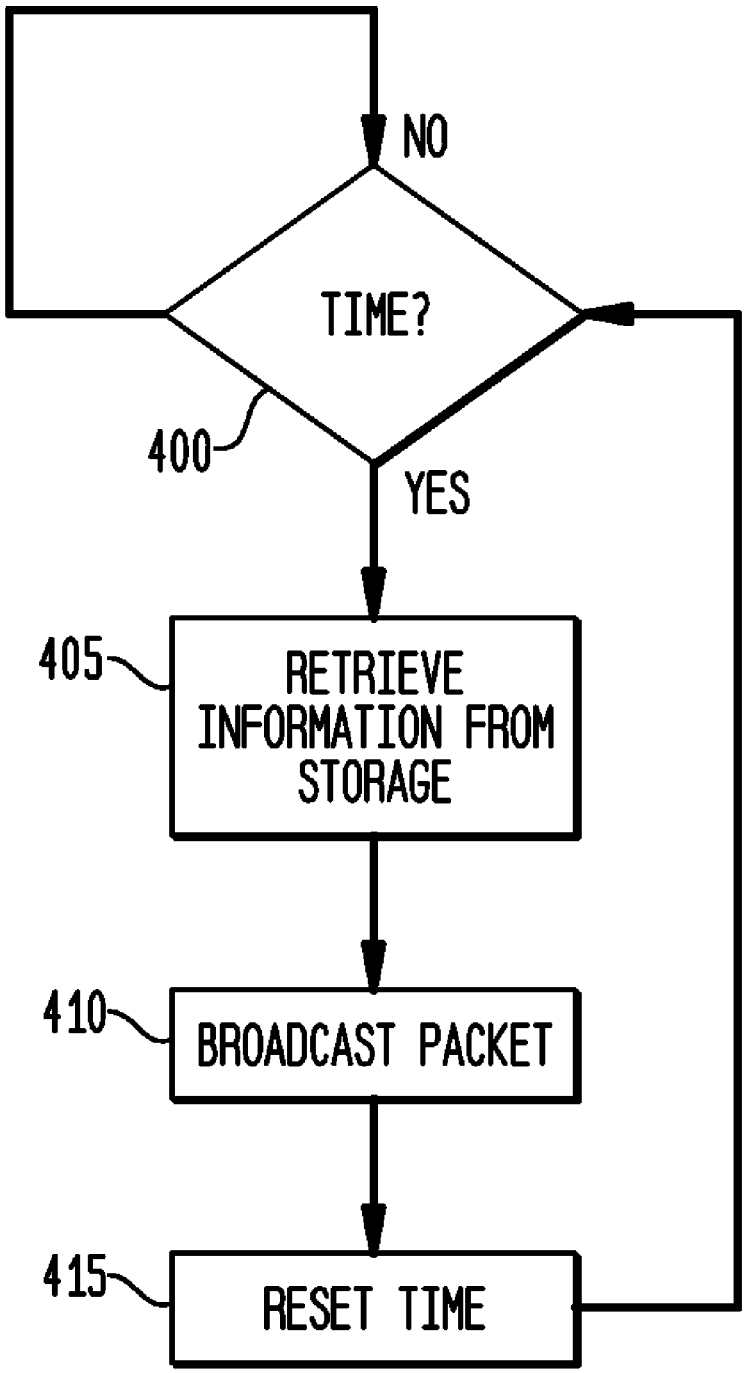
FIG. 4 illustrates a flow chart for a method of periodically broadcasting probe packets according to the invention.

FIG. 4 illustrates a method for broadcasting the probe packet. The probe packet is periodically delivered. The probe packet is used to exchange information between each of the equipped vehicles 10. The probe packet is broadcast. Any equipped vehicle 10 within the one hop radio range receives the probe packet. The time between deliveries of the probe packet can be changed based upon the local environmental and network conditions.

At step 400, the processor 205 determines if the time between deliveries has elapsed. The processor 205 only instructs the transmitter 220 to broadcast the probe packet after the time has elapsed. If the time has not elapsed, the processor 205 waits, e.g., remains at step 400. Once the time elapsed, the processor 205 causes the transmitter 220 to retrieve current information from the storage section 210 for broadcasting at step 405. The probe packet includes, but is not limited, the number of packets sent and received within a period of time, determined current position information, packet delays, equipped vehicles speed, transmission range, all parameters received in step 300, determined in step 315 and estimated in step 325. At step 410, the transmitter 210 broadcasts the probe packet. The probe packet includes the information from the storage section 210 and the broadcast time.

At step 415, the processor 205 resets the broadcasting time using the latest adjustment to the broadcasting time. The latest adjustment is retrieved from the storage section 210.

Figure 5:
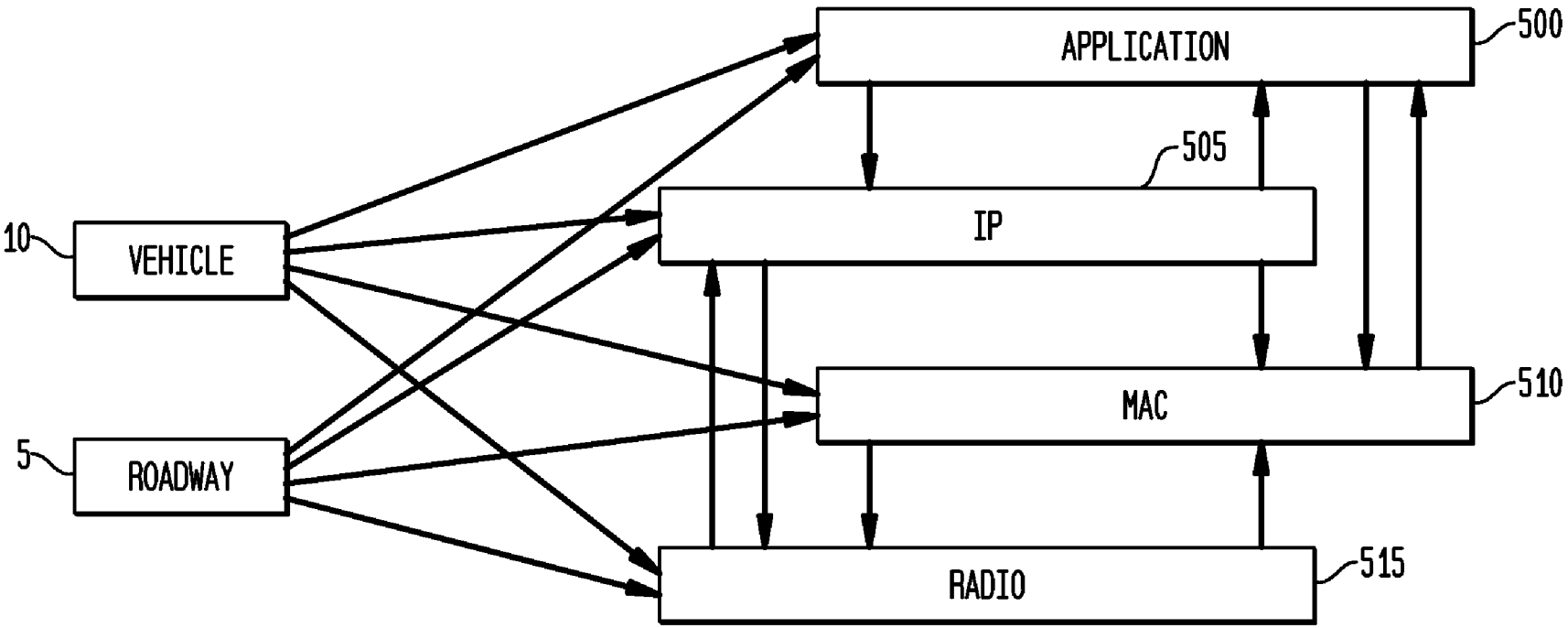
FIG. 5 illustrates layer architecture and data flow according to the invention.

FIG. 5 illustrates a layer architecture for the processor 205 and information exchanges between the layers and the external nodes according to an embodiment of the invention, e.g., other equipped vehicles 10 and RSU 5. FIG. 5 depicts the roadway information, environment and topology being broadcast from the RSU 5; however, the information can be received from the other equipped vehicles 10 or a priori known. The local environmental information, network information and locally determined parameters operating parameter are shared by all of the layers. For example, the information can be stored in the storage section 210 in a database which is available to all of the layers. Information that is determined by each layer is relevant to estimations for the other layers. For example, the MAC throughput and route selection impacts the application that can be used. The transmission range affects the MAC throughput and the channel selection.

The vehicle information and operating information (network information) from other equipped vehicles 10 and information related to other non-equipped vehicles 15 (e.g., from a camera 22) is made available across all of the layers, application layer 500, network layer 505, MAC layer 510 and Radio Layer 515. The one-way arrows represent current environment information, e.g., roadway information and vehicle information.

Figure 6:
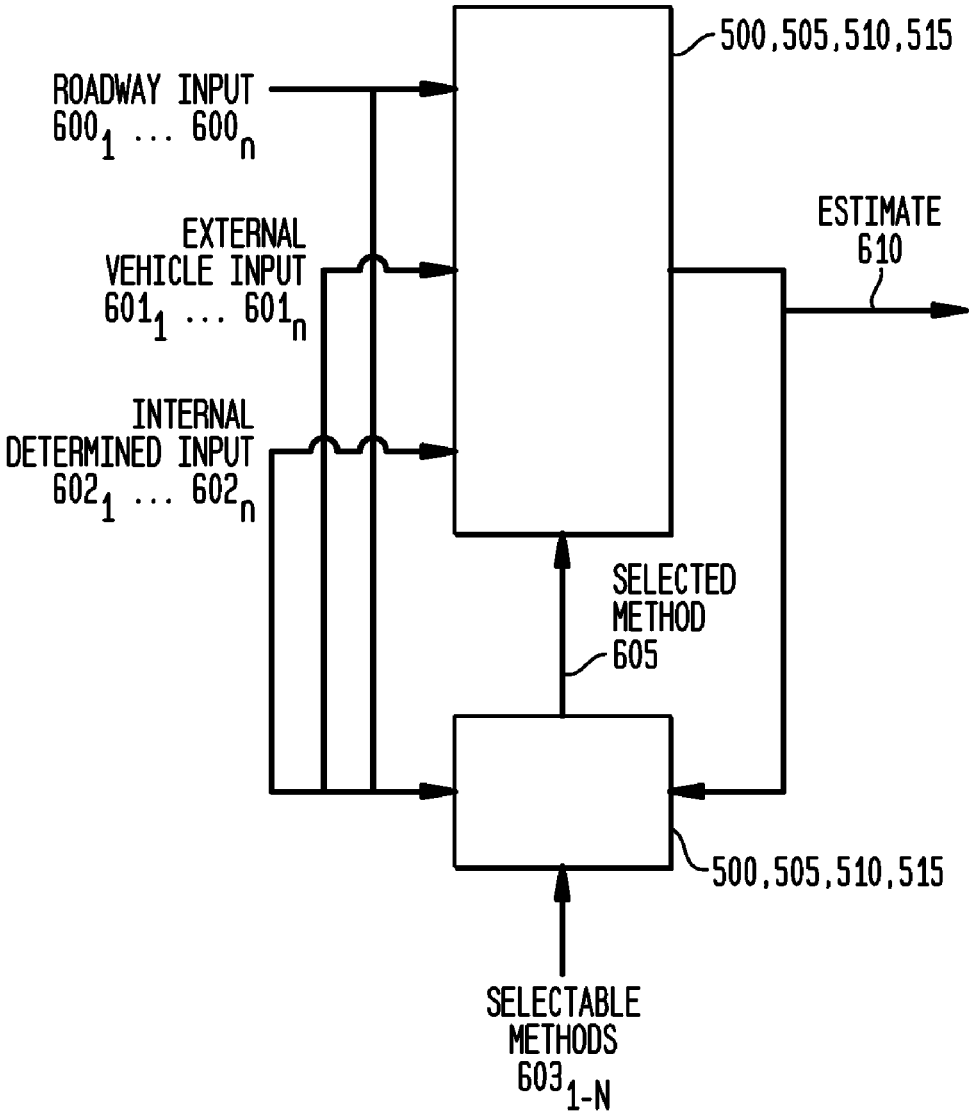
FIG. 6 illustrates a diagram of the data flow for estimating parameters according to the invention.

FIG. 6 illustrates a general block diagram of the estimation of a parameter according to the invention.

The needed inputs 600-602 are retrieved from the storage section 210 by one or more of the layers 500, 505, 510 and/or 515 (application layer 500, network layer 505, MAC layer 510 and Radio layer 515). For the purposes of the discussion inputs $\mathbf{600}_N$ are the inputs related to the roadway. Inputs $\mathbf{601}_N$ are inputs from other vehicles. Both $\mathbf{600}_N$ and $\mathbf{601}_N$ are external inputs which are received in steps 300 and 305 and are the current inputs. Inputs $\mathbf{602}_N$ are inputs that are determined by the estimating equipped vehicle, i.e., determined in step 315. For example, the inputs $\mathbf{600}_N$, $\mathbf{601}_N$ or $\mathbf{602}_N$ can be vehicle behavior, mobility information and roadway information in combination with the neighboring vehicle information and current location.

Additionally, the layer 500, 505, 510 and/or 515 select an estimation method ("selected method/model" 605) from among a plurality of available methods $\mathbf{603}_{1\text{-}N}$. The selected method(s) 605 are selected based upon the current local information (step 300, 305, 315) and prior period's estimation 610.

For example, the next-hop neighbor, e.g., equipped vehicle 10, can be estimated or predicted using relative speed, direction and position information, relative distance between vehicles (of the estimating vehicle and neighboring vehicles), application information, other vehicle wireless communications information, capacity and roadway information as inputs $\mathbf{600}_N$, $\mathbf{601}_N$ or $\mathbf{602}_N$.

A neighboring node (or next-hop vehicle) is limited by the number of lanes on a roadway 20 and the direction, i.e., one way or two way roadway as well as distance between highway exit and other roadway structures. Depending on the application, a neighboring node can be restricted to equipped vehicles 10 traveling in the same direction or opposite direction. Furthermore, there is a need to differentiate between equipped vehicles 10 and non-equipped vehicles 15. Non-equipped vehicles cannot communicate and provide probe packets, thus they are not used in next-hop neighbor prediction.

One of the layers 500, 505, 510 and/or 515 (e.g., network layer 505 or MAC layer 510) determines if an equipped neighbor is a candidate for being a next-hop neighbor (for routing use) in the future. At minimum, a candidate has to be within the transmission range of the estimating node (e.g., equipped vehicle 10) within a period of time in the near future. The period of time is adjustable.

The relative distance of a neighbor n is defined as $D_{R,n}(t+\Delta t)$, where $t+\Delta t$ is a time in the future, where the time is adjustable. A neighbor remains a candidate if the neighbor at time $t+\Delta t$ will still be in radio range, i.e., $D_{R,n}(t+\Delta t) \leqq$ Transmission range.

The estimation of the next-hop equipped vehicle can be made using either a vehicle-roadway distribution method $\mathbf{603}_1$ or a least variable method $\mathbf{603}_2$. The two methods described herein are only examples. Any number of other methods can be used.

If the vehicle-roadway distribution method $\mathbf{603}_1$ is used as the selected method 605 the probability that a neighbor n is within the radio range is estimated by the following formula:

$$P(\text{neighbor } n(t+\Delta t))=f(D_{R,n}(t+\Delta t),\text{range},\text{model}) \quad (1)$$

The model used for this method is based upon the spatial awareness of the roadway 20, application constraint and MAC/Radio capabilities. This is another example of cross layer interaction required for the network and communications device control. A useful candidate is limited by the number of lanes on a roadway 20 and the direction, i.e., one way or two way roadway as well as distance between highway exit and other roadway structures. Depending on the application, a neighboring node can be restricted to each equipped vehicles 10 traveling in the same direction or opposite direction, or potentially vehicles at intersections traveling at orthogonal direction.

For example given a bi-directional roadway, some probability P vehicles which are located more than x meters latitude and y meters longitude are likely to be in the lane going in the opposite direction. The vehicle-Roadway Distribution method $\mathbf{603}_1$ can increase the probability to choose only neighbors going in the same/opposite direction, e.g. the function includes a multiplier that increases or decreases based upon a direction.

If the selected method 605 is the least variable neighbor $\mathbf{603}_2$ method, a next-hop candidate is selected as an equipped vehicle 10 that has the least varying distance with respect to the estimating node. The next-hop neighbor candidates are identified based upon the following formula:

$$\text{Abs}((D_{R,n}(t+\Delta t)-D_{R,n}(t))<\delta_n \quad (2)$$

where $\delta_n$ is a position bias. The inputs $\mathbf{600}_N$, $\mathbf{601}_N$ or $\mathbf{602}_N$ to the selected method 605 are the same as for the vehicle-roadway distribution method $\mathbf{603}_1$ except that the relative position history and previous next-hop information is also used. The position bias $\delta_n$ is a bias toward selecting neighbors that have been next-hop equipped vehicles in previous periods (intervals) in order to reduce routing updates. In other words, the $\delta_n$ is defined to create bias toward more relatively stable neighbors. The smaller the bias the more likely the neighbor that was a next-hop equipped vehicle in the previous period will be selected. One of the candidates identified by formula 2 is selected as the next-hop node.

In an embodiment, the selected method 605 is based on the application information or requirements. If an application requires a long period of time to deliver a large packet, the least variable neighbor method is selected to predict the next-hop node. Some application may not have a long duration so choosing a stable neighbor and route may not be the primary constraint.

In an embodiment, the bias can be based on roadway information, application information, MAC and radio performance information. For example, the next-hop node can be predicted or selected based upon a requirement for the most one-hop neighbors, node to reach multiple destinations (for multicast) or node with least load (QoS-aware routing).

If no next-hop equipped vehicle is available that meets all of the requirements, other layers will change one of the performance requirements, e.g., cross-layer interaction will occur. For example, the MAC layer 510 can adjust power/channel to get better neighbors. Alternatively, the RSU 5 is used to reach destinations via flexible V-R/V-V channel selection.

In another embodiment, the local information, both internally determined in step 315 and received from an external source in steps 300 and 305, are used to estimate the total vehicle density, i.e., input $\mathbf{700}_N$-$\mathbf{702}_N$. The total vehicle density includes both the equipped vehicles 10 and non-equipped vehicles 15. The total vehicle density is used as a basis for indicating roadway congestion which might cause roadway delays and traffic congestion. The total vehicle density will also result in a modification to the expected speed, e.g., lower speed than the speed limit or a change in the vehicle route.

Non-equipped vehicles 15 can be detected from collision avoidance systems such as road cameras 22. Additionally, non-equipped vehicles can be estimated based upon a probability of equipped vehicles and roadway information.

Figure 7:
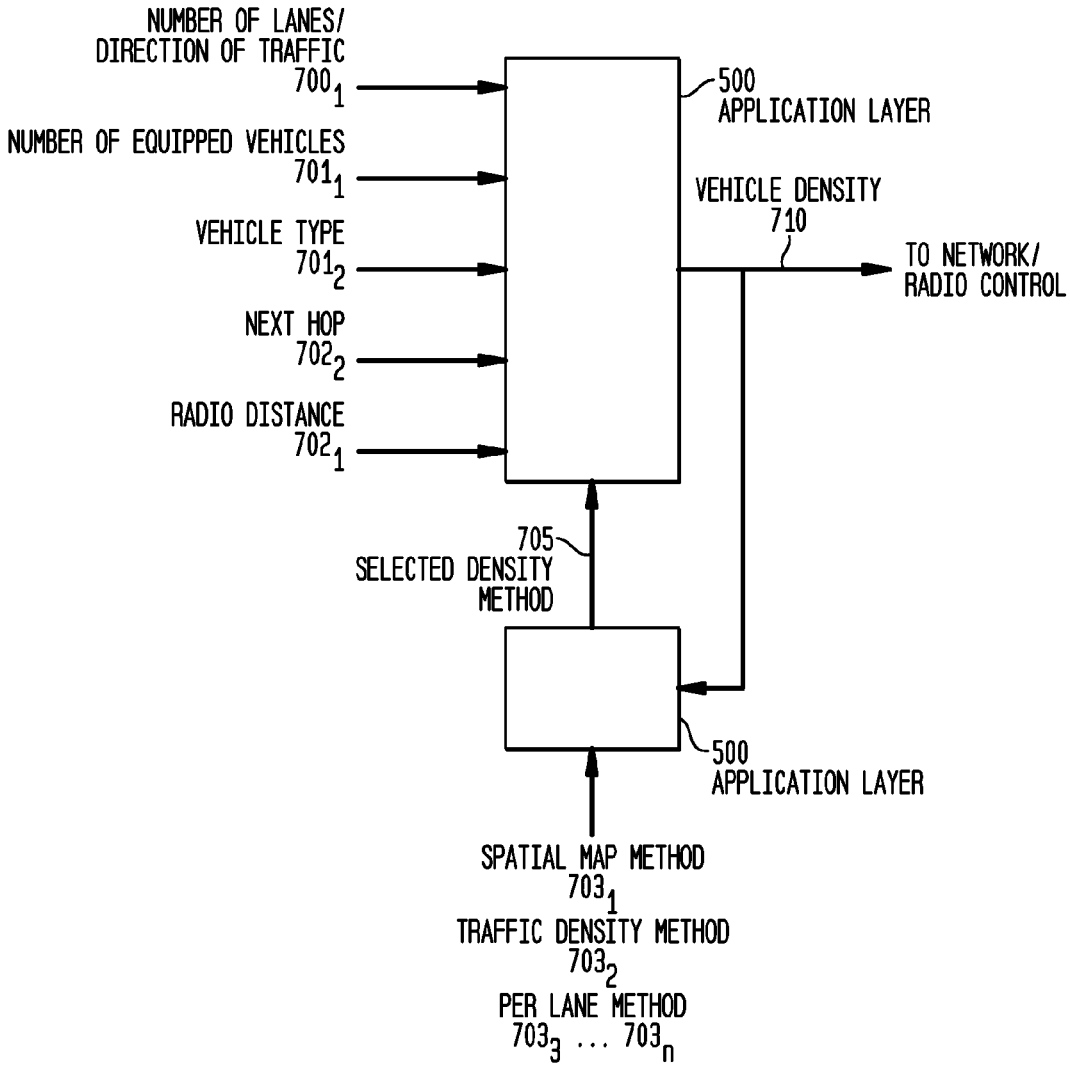
FIGS. 7-8 illustrate exemplary estimations of parameters.

FIG. 7 illustrates diagram of the information flow for determining the vehicle density. The number of detected equipped vehicles $\mathbf{701}_1$, distance between vehicles and vehicle type $\mathbf{701}_2$, predicted next-hop equipped vehicles $\mathbf{702}_2$, MAC and radio information $\mathbf{702}_1$ and number of lanes and direction of traffic $\mathbf{700}_1$ can be used as inputs for determining the vehicle density. Additionally, a detection area is set in advanced. This area can be changed based upon current environment and local conditions. For example, the area can be the distance between exits on a highway.

The application layer 500 selects a method for estimating the vehicle density 705. The select method 705 can be selected from a plurality of selectable method 703, e.g., spatial graph method $\mathbf{703}_1$, traffic density method $\mathbf{703}_2$ and per lane method $\mathbf{703}_3$. The three methods described herein are only examples. Any number of other methods can be used.

Additionally, other information such as relative position of the vehicles, size of the vehicles (determined from make and model $\mathbf{701}_2$) and direction of travel, estimated based upon position and location information is needed. All of the information is either received from an RSU 5, other equipped vehicles 10 via probe packets or determined locally.

The spatial method $\mathbf{703}_1$ maps known positions of the equipped vehicles 10 accounting for size, and the relative position of non-equipped vehicles 15. The size of each vehicle can be estimated using a size factor. The size factor is typically used to estimate the size of non-equipped vehicles 15. Alternatively, the size is a priori known or received from the other equipped vehicles.

The size factor can be adjustable using a weighted average of the known size of the equipped vehicles 10. The method also accounts for overlapping vehicles. Overlapping vehicles result from multiple equipped vehicles reporting information regarding the same equipped vehicle 10 or non-equipped vehicle 15. The overlapping equipped vehicles 10 or non-equipped vehicles 15 are removed from the mapping. Duplicate information is deleted from the storage section 210.

The spatial method $\mathbf{703}_1$ counts a number of vehicles within a set area on the mapping. The position of each equipped vehicle 10 is known via information from the probe packets. The known position is superimposed on the spatial map. The relative position of the non-equipped vehicles 15 is deduced or estimated and then superimposed on the spatial map.

The traffic density method $\mathbf{703}_2$ accounts for the distance and speed of the vehicles as well as MAC information, radio information, and roadway information such as time of day, roadway type and area. The specific traffic density model used in the traffic density method $\mathbf{703}_2$ changes based upon the time of day, roadway type and area. The method estimates a total number of vehicles per lane (and for all lanes).

The per lane method $\mathbf{703}_3$ uses an average inter-vehicle distance within the same lane to extrapolate a total number of vehicles in the same lane within a given length, e.g., equipped vehicles 10.

In an embodiment, the given length is preset. Alternatively, the given length is adjustable based upon the time of day, type of roadway, application, and type of location.

Specifically, the per lane model $\mathbf{703}_3$ uses a deduction of an average distance between the front and rear of two successive vehicles in the same lane to estimate the total number of vehicles in each lane. The density in a lane is inversely proportional to the inter-vehicle distance (including vehicle size).

Inputs $\mathbf{700\text{-}702}_n$ to the per lane model includes roadway information such as, but not limited to time of day, total number of lanes in each direction $\mathbf{700}_1$, roadway type, minimum and maximum inter-vehicle distances (based upon safety requirements and speed), MAC information and radio information $\mathbf{702}_1$, size of each vehicle and determined average distance between vehicles.

The per-lane density is calculated using the following formula:

$$\text{Density}_L(x)=x*\beta/(D_{avg}(L)+\text{vehicle length}), \quad (3)$$

where "x" is the given lane length, $D_{avg}(L)$ is the average inter-vehicle distance and the vehicle length is the average size of a vehicle. β is a bias. A bias is used to account for the type of roadway, location of the roadway and time of day (such as rush hour) to improve the estimate and to account from current environmental conditions.

Since the actual size of all of the vehicles in a given lane may not be known, in an embodiment, the average length of a vehicle is determined using a vehicle size distribution model. The model uses observed information either from other equipped vehicles 10 or an RSU 5 or preset information. The total lane density is equal to the sum of all of the per lane estimates.

The simplest estimation method is the per lane method $\mathbf{703}_3$. This method does not need information from a probe packet. However, the probe information can be used to increase the accuracy. The lane method $\mathbf{703}_3$ is selected as the method 705 when probe packets are not received when the estimate is needed.

Information received from the equipped vehicle 10 and current local environment and operating information is also used to estimate the network performance such as local and end-to-end capacity, i.e., MAC capacity. Vehicle density, roadway topology, radio range, available maximum bandwidth and channels, active per vehicle load and network load, affect the MAC capacity. For example, interference can be caused when multiple neighboring equipped vehicles 10 simultaneously send packets. Furthermore, wireless signal propagation loss such as signal and channel fading causes packet loss. Since interference and fading loss impact the MAC capacity, the actual throughput is determined in real-time directly rather than trying to estimate the impact of the interference and/or signal fading losses.

The MAC capacity estimate is used to adapt the selection of the next-hop equipped vehicle, reduce or increase radio power and/or adjust the channel assignment. Additionally, the MAC capacity estimate can be used to adjust the send rate and back-off time in order to reduce collisions, increase buffer size and increase successful packet delivery.

The application layer 500 can use the MAC capacity estimate to adjust the QoS allowance and control the number of active application sessions.

Figure 8:
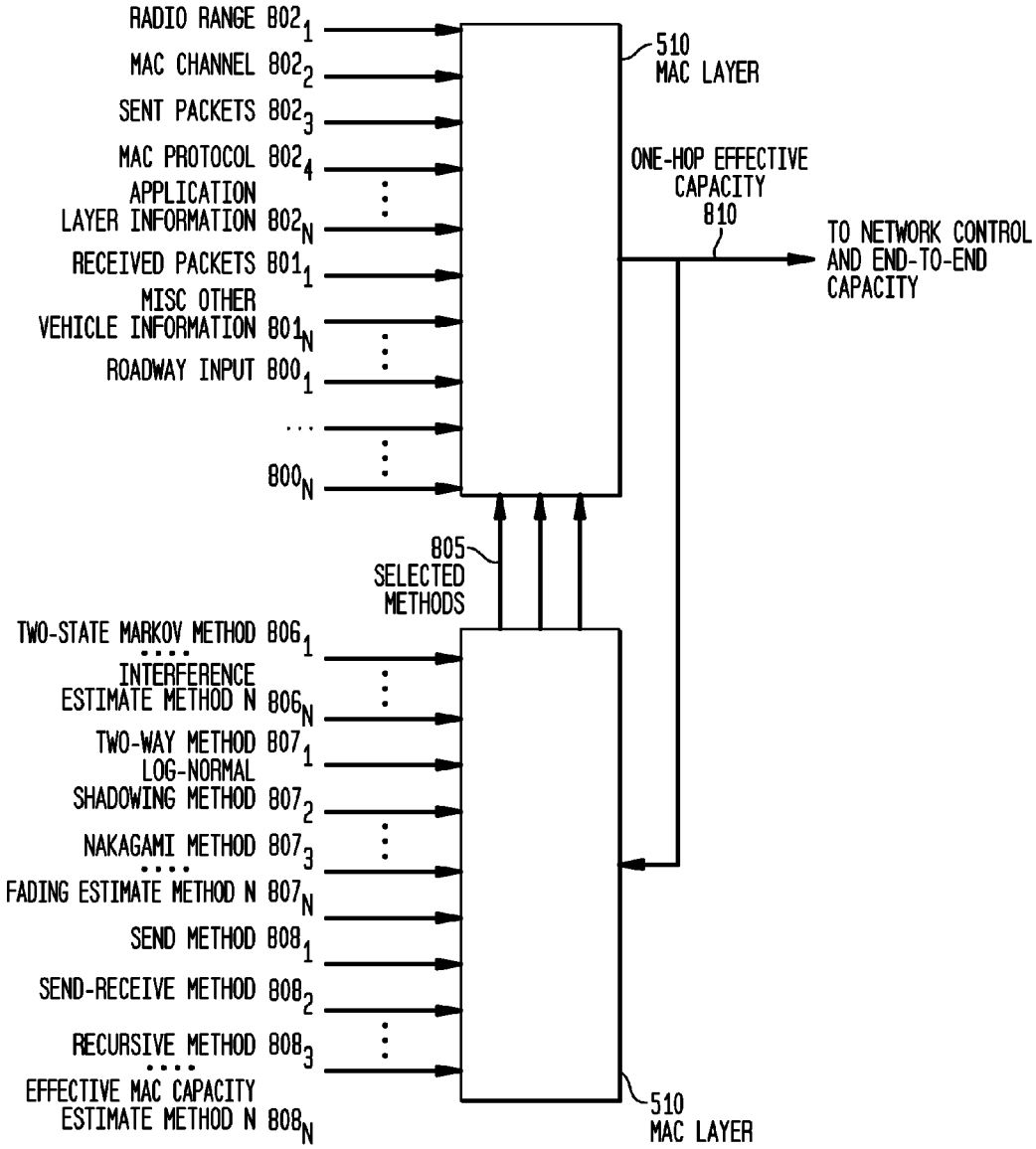

FIG. 8 illustrates a block diagram for the estimation of the MAC capacity, e.g., 810, for an active equipped vehicle 10. As depicted in FIG. 8, roadway information $\mathbf{800}_{1\text{-}N}$, other equipped vehicle information $\mathbf{801}_{1\text{-}N}$ (including number of received packets), application information $\mathbf{802}_N$, in addition to determined information such as radio range $\mathbf{802}_1$, channel $\mathbf{802}_2$, number of sent packets $\mathbf{802}_3$, and MAC protocol $\mathbf{802}_4$ are the inputs for estimating the local and network MAC capacity 810. The radio range $\mathbf{802}_1$, channel information $\mathbf{802}_2$ and number of sent $\mathbf{802}_3$ and received packets $\mathbf{801}_1$ are for the current period, i.e., current local information. The roadway information $\mathbf{800}_{1\text{-}N}$ can be received from an RSU 5. The send rates and time to access the channel can be also measured or calculated. A current send rate is the upper theoretical bound on the effective MAC capacity. The theoretical upper bound is limited by the frequency band and signal to noise ratio. The actual throughput or effective MAC capacity is lower than the current send rate as not all packets are received. The actual MAC capacity is determined using the actual send rate and a probability for packet loss due to channel conditions and interference (collision). To estimate the loss due to interference and fading several different selectable methods $\mathbf{806}_{1\text{-}N}$ and $\mathbf{807}_{1\text{-}N}$ can be used. The different methods $\mathbf{806}_{1\text{-}N}$ and $\mathbf{807}_{1\text{-}N}$ will be described below.

For inactive equipped vehicles (nodes) 10 (vehicles not currently transmitting or waiting to transmit) the estimation is similar to active equipped vehicles, except the application information, send rates and numbers of sent packets are not used. The inactive equipped vehicles instead uses as input 600 the number of equipped vehicles, send rate of neighboring equipped vehicles and duplicate packets received.

Inactive equipped vehicles sense channel usage. The carrier-sensing uses standard wireless carrier sensing and will not be described in detail. Each equipped vehicle 10 overhears activity on each channel.

The MAC capacity has numerous components. Each component, e.g. sources, is estimated using a separate selectable method, e.g. $\mathbf{806}_{1\text{-}N}$ and $\mathbf{807}_{1\text{-}N}$. The MAC effective capacity is estimated as a combination of the components. For example, collision or interference for a channel is estimated using one interference method $\mathbf{806}_{1\text{-}N}$, e.g., one-hop link collision method, two-state Markov method $806_1$, etc. The channel error due to fading is estimated using one of a plurality of one-hop link propagation models $807_{1-N}$, e.g., Two-way Method $807_1$, Log-Normal Shadowing Method $807_2$ or Nakagami Method $807_3$.

The theoretical throughput is estimated using an ideal signal to noise ratio model with the following formula $$C=\text{BW}\log(1+\text{SNR}/\text{BW})\ \text{bits/sec}, \tag{4}$$

where C is the theoretical upper bound on the throughput, BW is the channel bandwidth and SNR is the Signal-to-Noise Ratio.

Each of the methods 805 is selectable from a plurality of available methods $806_{1-N}$-$808_{1-N}$. The methods are selected based upon current environmental conditions, e.g., roadway conditions. For example, different methods $806_{1-N}$-$808_{1-N}$ are selected based upon the roadway type (highway, rural, local roads, one lane, multi-lane, etc.) or relative speeds. Additionally, distance between vehicles affects the signal propagation and channel fading. Therefore, different methods 805 are selected.

The estimation of the actual throughput (effective) of the MAC is determined by adjusting the actual send rates using the estimated loss from the interference and fading. The method for estimating the actual throughput in a channel is selectable from at least send-rate method $808_1$, send and receive-rate method $808_2$ and recursive methods $808_3$, or another selectable method $808_N$.

Interference reduces the probability that a packet will be successfully delivered. Additionally, interference reduces the maximum sending rate of a transmitting node. Interference is controlled or limited using a variable MAC protocol, where the backoff time and channel can be adjusted by the MAC layer 510. The channel is adjusted using carrier sensing and SNR thresholds by the physical layer (radio layer 515). The selected method $805_N$ will depend on the mobility patterns, application information, local roadway environment, number of neighboring equipped vehicles speed of the equipped vehicles 10 and vehicle density both current information and a period prior. This information is either received in steps 300 and 305 or determined in step 315.

The method for estimating the channel fading in a channel is selectable from at least a two-ray ground $807_1$, log-normal shadowing $807_2$ and Nakagami method $807_3$. Channel fading occurs due to some randomness of a radio wave's propagation. The radio waves are also degraded by reflecting objects. In VANETs channel fading is exacerbated by the speed in which equipped vehicles 10 are moving. The selected method 805 will depend on the mobility patterns, local roadway environment, weather, speed of the equipped vehicles 10 and vehicle density both current information and a period prior. This information is either received in steps 300 and 305 or determined in step 315.

As depicted in FIG. 8 there are several locally determined parameters and several external parameters which are inputs for the estimation of the capacity 810. The received packets $801_1$ is the number of packets received since the last MAC capacity estimation. The number of received packets $801_1$ is obtained from the probe packet received from neighboring equipped vehicles 10 (step 305). The sent packets $802_3$ is the number of packets sent since the last MAC capacity estimation. The equipped vehicle 10 also determines an average idle time ratio, number of retransmissions per sent packet, average backoff time, set backoff time, and average queue length (step 315). The radio range and radio capacity $802_1$ is also determined at step 315. The equipped vehicle 10 also determines the number of neighboring equipped vehicle from information received from the probe packets at step 315.

The MAC layer 510 performs the MAC capacity estimations 810.

According to the send rate-based method $808_1$, the one-hop effective MAC capacity 810 for a future time Δt+T is estimated by the following formula $$C(T+\Delta t)=\rho_{ch}(\Delta t)*R^f_{Loss}*R^C_{Loss} \tag{5}$$

where C(T+Δt) is the estimated effective capacity, $\rho_{ch}(\Delta t)$ is the packet send rate during the interval Δt, $R^f_{Loss}$ is a loss ratio due to propagation (fading) and $R^C_{Loss}$ is a loss ratio due to interference (collision).

If $\rho^n_{ch}(\Delta t)>0$ for every neighboring equipped vehicle, n, then every node could be trying to access channel. If $\rho^n_{ch}(\Delta t)>0$ for some neighboring equipped vehicles n, few neighboring nodes trying to access channel. The ideal capacity for a channel needed to support communication during any interval is $\Sigma\rho^n_{ch}(\Delta t)$.

According to the send and receive rate method $808_2$, the one-hop effective MAC capacity 810 for a future time is estimated by the following formula $$C(T+\Delta t)=\rho_{ch}(\Delta t)*R_{Loss}, \tag{6}$$

where $R_{Loss}=f(\Sigma_n\rho^n_{ch}(\Delta t), \Sigma_n R^n_{ch}(\Delta t))$. The $R^u_{ch}(\Delta t)$ is the receive rate of neighboring equipped vehicle, n is the number of neighboring vehicles using the same channel in the interval and the $\rho_{ch}(\Delta t)$ is the packet send rate of the equipped vehicle 10. The $\Sigma_n\rho^n_{ch}(\Delta t)$ is the packet send rate of one-hop neighborhood (all one-hop neighboring equipped vehicles) and $\Sigma_n R^n_{ch}(\Delta t)$ is the packet receive rate of one-hop neighborhood. $R_{loss}$ includes loss due to interference and channel fading. The $R_{loss}$ ratio is derived and is used in all neighboring equipped vehicles. The $R_{loss}$ for each neighboring equipped vehicle will be approximately the same since similar one-hop neighborhood send and receive rates are used.

The recursive method $808_3$ estimates the one-hop effective MAC capacity 810 using the following formula $$C(T+\Delta t)=\alpha[\rho_{ch}(\Delta t)*R^f_{Loss}*R^c_{Loss}]+\beta\Sigma_k TH^m(\Delta t-kT), \tag{7}$$

where $TH^m(\Delta t-kT)$ are previous measured throughputs, k is the number of previous measured throughputs, α and β are weights adjusting for the current measurement and previous measurements.

K, α and β are parameters that are adjustable based upon local environmental information such as the internally determined parameters (step 315) and the received information (steps 300 and 305).

The frequency of estimation for the estimated parameters (i.e., step 325) is variable based on of local environmental information such as the internally determined parameters (step 315) and the received information (steps 300 and 305) and previous estimates. For example, if the channel and capacity is stable, less estimation will occur, i.e., increase Δt. However, if the roadway or channel is changing rapidly, more estimation occurs, i.e., decrease Δt in order to do estimations at shorter intervals. The frequency of estimation can be the same as the frequency of the determination of the local parameters (step 310). Alternately, the frequency of the estimation can be separately controlled. Additionally, the frequency for each separate estimation can be separately controlled such that the estimations are staggered.

In another embodiment, the order for each separate estimation is prioritized based on application requirements. Some applications require a higher bandwidth, while other focus on delivery delay, e.g., safety applications.

The invention has been described herein with reference to a particular exemplary embodiment. Certain alterations and modifications may be apparent to those skilled in the art, without departing from the scope of the invention. The exemplary embodiments are meant to be illustrative, not limiting of the scope of the invention, which is defined by the appended claims.

What is claimed:

1. A method of controlling a wireless communication device that is installed in a moving vehicle, the method comprising:

receiving roadway topology information and vehicle traffic pattern information;

receiving vehicle information from a plurality of other moving vehicles and wireless performance parameters corresponding to each of the plurality of other moving vehicles related to the performance of a wireless communication device installed in each of the plurality of other moving vehicles;

determining current position information for the moving vehicle;

determining a first set of metrics for a performance of the wireless communication device installed in the moving vehicle;

estimating at least one second metric related to the performance of the wireless communication device or an ad-hoc network which includes each wireless communication device, the at least one second metric is based upon at least a sub-set of the first set of metrics, the received roadway topology information, vehicle traffic pattern information, vehicle information and wireless performance parameters from the plurality of other moving vehicles and the determined current position information for the moving vehicle; and changing an operation or routing parameter for the wireless communication device based upon the estimation.

2. The method according to claim 1, further comprising:

storing the received roadway topology information, vehicle traffic pattern information, vehicle information and wireless performance parameters from each of the plurality of other moving vehicles, the first set of metrics, the current position information, the estimated at least one second metric and the changed operation or routing parameters as stored data in memory.

3. The method according to claim 2, further comprising:

maintaining the stored data for a period of time as network operating history.

4. The method according to claim 3, further comprising:

transmitting periodically the network operating history to at least a subset of the plurality of other moving vehicles.

5. The method according to claim 4, wherein the transmission period is adjustable based upon the received roadway topology information, vehicle traffic pattern information, vehicle information and wireless performance parameters from each of the plurality of other moving vehicles, the first set of metrics, the current position information, and the estimated at least one second metric.

6. The method according to claim 3, further comprising:

providing the stored network operating history to an application layer, an IP network layer, a MAC layer and physical layer for the determining of the first set of metrics and the estimating of the at least one second metric.

7. The method according to claim 1, further comprising:

selecting a method for estimating the at least one second metric from a plurality of methods, the method is selected based upon at least one prior period of the estimated at least one second metric and the determined first set of metrics and location information for a current period.

8. The method according to claim 1, wherein the estimating of the at least one second metric is periodically performed, the period is adjustable based upon at least one prior period of the estimated at least one second metric and the determined first set of metrics and location information for a current period.

9. The method according to claim 1, wherein the roadway topology information and vehicle traffic pattern information is received from a roadside unit.

10. The method according to claim 1, wherein the roadway topology information and vehicle traffic pattern information includes speed limit, number of lanes, direction of traffic, type of roadway, intersection information, traffic light locations and regions.

11. The method according to claim 1, wherein the vehicle information includes vehicle make, model, size, speed, direction and location.

12. The method according to claim 1, wherein the at least one second metric is a predicted next-hop neighbor.

13. The method according to claim 1, wherein the at least one second metric is a vehicle density.

14. The method according to claim 1, wherein the at least one second metric is a one-hop MAC capacity.

15. The method according to claim 1, wherein the roadway topology information and vehicle traffic pattern information is downloaded from mapping and traffic applications.

16. A computer readable medium storing a computer readable program of instructions for execution by a computer, the instruction causing the computer to perform a method of controlling a wireless communication device that is installed in a moving vehicle, the method comprising:

receiving roadway topology information and vehicle traffic pattern information;

receiving vehicle information from a plurality of other moving vehicles and wireless performance parameters corresponding to each of the plurality of other moving vehicles related to the performance of a wireless communication device installed in each of the plurality of other moving vehicles;

determining current position information for the moving vehicle;

determining a first set of metrics for a performance of the wireless communication device installed in the moving vehicle;

estimating at least one second metric related to the performance of the wireless communication device or an ad-hoc network which includes each wireless communication device, the at least one second metric is based upon at least a sub-set of the first set of metrics, the received roadway topology information, vehicle traffic pattern information, vehicle information and wireless performance parameters from the plurality of other moving vehicles and the determined current position information for the moving vehicle; and changing an operation or routing parameter for the wireless communication device based upon the estimation.

* * * * *